United States Patent [19]

Nakao

[11] Patent Number: 4,578,884

[45] Date of Patent: Apr. 1, 1986

[54] PORTABLE STEAM IRON

[75] Inventor: Kiyoshi Nakao, Tottori, Japan

[73] Assignees: Sanyo Electric Co., Ltd.; Tottori Sanyo Electric Co., Ltd., both of Japan

[21] Appl. No.: 669,113

[22] Filed: Nov. 7, 1984

[30] Foreign Application Priority Data

Nov. 16, 1983 [JP] Japan ..... 58-216502
Nov. 19, 1983 [JP] Japan ..... 58-179341[U]

[51] Int. Cl.[4] ..... D06F 75/14; D06F 75/30; D06F 75/34; D06F 75/36

[52] U.S. Cl. ..... 38/77.3; 38/92

[58] Field of Search ..... 38/77.8, 88, 91, 92, 38/77.3

[56] References Cited

U.S. PATENT DOCUMENTS 3,949,499 4/1976 Schaeffer et al. ..... 38/77.3
4,484,399 11/1984 Biancalani ..... 38/77.3

FOREIGN PATENT DOCUMENTS 2732119 1/1978 Fed. Rep. of Germany ..... 38/77.8

*Primary Examiner*—Werner H. Schroeder
*Assistant Examiner*—Andrew M. Falik
*Attorney, Agent, or Firm*—Darby & Darby

[57] ABSTRACT

A steam iron comprising a thin iron main body is disclosed, the main body having a steam generating chamber. A box-like casing capable of housing the iron main body when the iron is not in use is provided. The casing is detachably mounted to the iron main body to constitute a handle when in use, and a water reservoir mounted in the front portion of the box-like casing feeds water to the steam generating chamber in the iron main body.

14 Claims, 9 Drawing Figures

PORTABLE STEAM IRON

BACKGROUND OF THE INVENTION

1. Field of the Invention

This invention concerns a steam iron and, more specifically, it relates to a portable steam iron having a handle and a water reservoir which are detachable from an iron main body.

2. Description of the Prior Art

Ordinary steam irons generally comprise a soleplate perforated with a plurality of steam emission apertures and a steam generating chamber in communication therewith, a water reservoir secured to the soleplate and in communication with the steam generating chamber by way of a water dropping channel, a housing secured to the upper part of the reservoir and a handle securely attached to the upper surface of the housing (refer, for example, to U.S. Pat. No. 3,369,103).

However, the steam iron of such a type in which the soleplate, reservoir, housing and handle are secured respectively in an integrated structure is not suitable for portable use and is also inconvenient in use since water has to be supplied to the reservoir while holding the rather heavy iron body.

In a steam iron proposed for improving the foregoing disadvantage of feeding water to the reservoir, the reservoir has been made detachable to the iron main body so that water may be fed to the reservoir in the detached state. Although this improved structure can facilitate the water feeding, it still lacks in the aspect of portability. In addition, since the reservoir is left as is after use, i.e., attached to in the iron main body, water remaining in the reservoir will flow downwardly to the steam generating chamber to cause undesired corrosion therein (refer, for example, to Japanese Published Examined Utility Model Application No. 16153/1975).

Further, there has been proposed an iron equipped with a spray device wherein a handle provided with a spray device is detachably mounted to an iron main body. The body is adapted to be stored in the hollow portion of the handle to reduce the entire size of the iron (refer, for example, to Japanese Published Unexamined Utility Model Application No. 157495/1983). However, although this iron can spray cold water to the matter to be pressed, it can not conduct efficient pressing work while jetting out high temperature steam.

SUMMARY OF THE INVENTION

This invention provides a portable steam iron comprising an iron main body of reduced thickness, and a box-like thin casing substantially in the same thickness as that of the iron main body for storing at least one-half the length of the iron main body when the iron is not in use. The casing can be detachably mounted on the iron main body to constitute a handle and a water reservoir is housed in the forward portion of the casing.

The iron main body has an internal steam generating chamber which is heated by a heating element. The heating element, which also heats an iron soleplate, may be controlled by a manually adjustable thermostatic switch.

The water reservoir can be adapted such that it may be detachably mounted on the casing.

The water reservoir may be provided with a water feeding opening with a cap having a plug for preventing water leakage.

The housing, preferably, has a forward retainer and a rearward retainer on the upper surface thereof so that the casing can be attached to be used as the handle by means of the retainers to the upper surface of the housing. In this case the lower rearward end of the casing may be retained by the rearward retainer which is biased by a spring.

Preferably, a water charging or filling port in the iron main body is surrounded at its top end by the forward retainer, opens at the top face of the forward retainer and has in its inside a packing made of a heat resistant elastic resin into which a water charging valve on the detachable reservoir is inserted. Further, a pre-heating chamber may be located at the lower end of a cylinder communicating the water charging or filling port with the steam generating chamber.

It is preferred, upon mounting the casing on the iron main body, that the rear end of the casing is situated ahead of the rear end of the iron main body and the front face of the reservoir contained in the forward portion of the casing is situated ahead of the front end of the soleplate.

This invention provides a portable type steam iron which is both easy to pack for travel and convenient to use. Further, since the water reservoir is detached from the iron main body and separated from the steam generating chamber when not in use use, intrusion of residual water in the reservoir into the steam generating chamber which would cause undesired corrosion to the chamber is prevented. In addition, since the separation of the reservoir from the steam generation chamber causes the chamber to be exposed to the external air to promote the drying of the inside, corrosion in the chamber may also be avoided. Further, since the reservoir is detachable from the casing, water can be supplied to the reservoir by holding only the detached reservoir. Furthermore, since the casing and the reservoir have substantially the same width and the thickness, the water capacity of the reservoir can be maximized while keeping the appearance neat and simple. In addition, as the casing and the reservoir have substantially the same width and thickness, the reservoir can be attached and detached simply by gripping the casing in one hand and in the handle the other hand. The side of the reservoir may be generally coplanar with that of the casing so that they can be placed on the upper surface of the table or the like without applying the localized load on the reservoir.

DESCRIPTION OF THE PREFERRED EMBODIMENT

This invention will be specifically described by way of a preferred embodiment thereof referring to FIG. 1 through FIG. 7.

Figure 1:
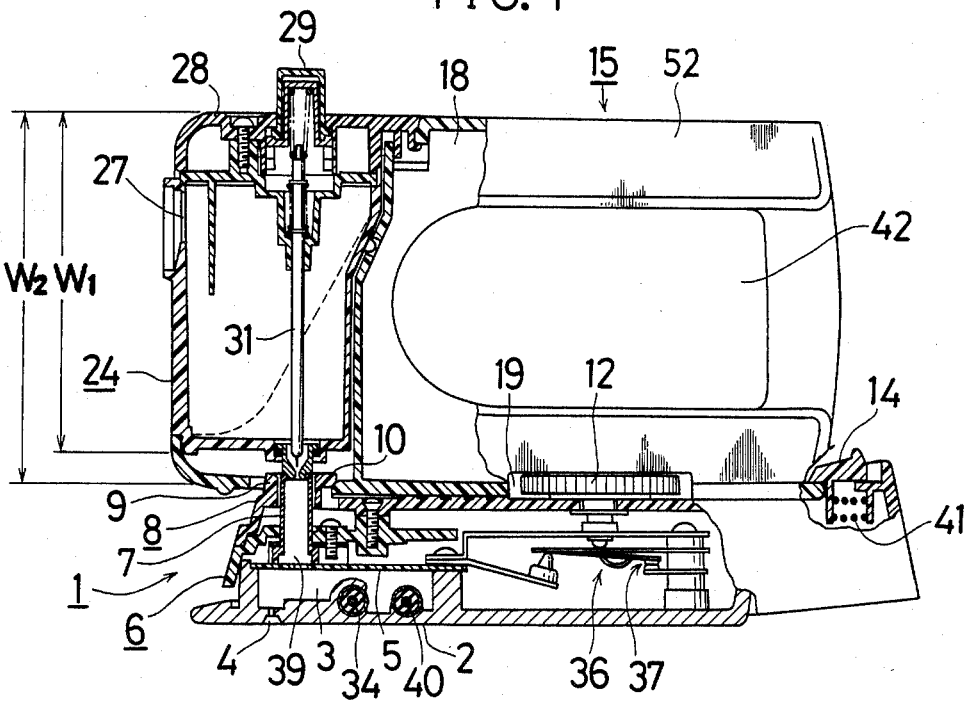
FIG. 1 is an elevational view partially in section of the construction for one embodiment of a portable steam iron according to this invention, assembled for use.
Figure 2:
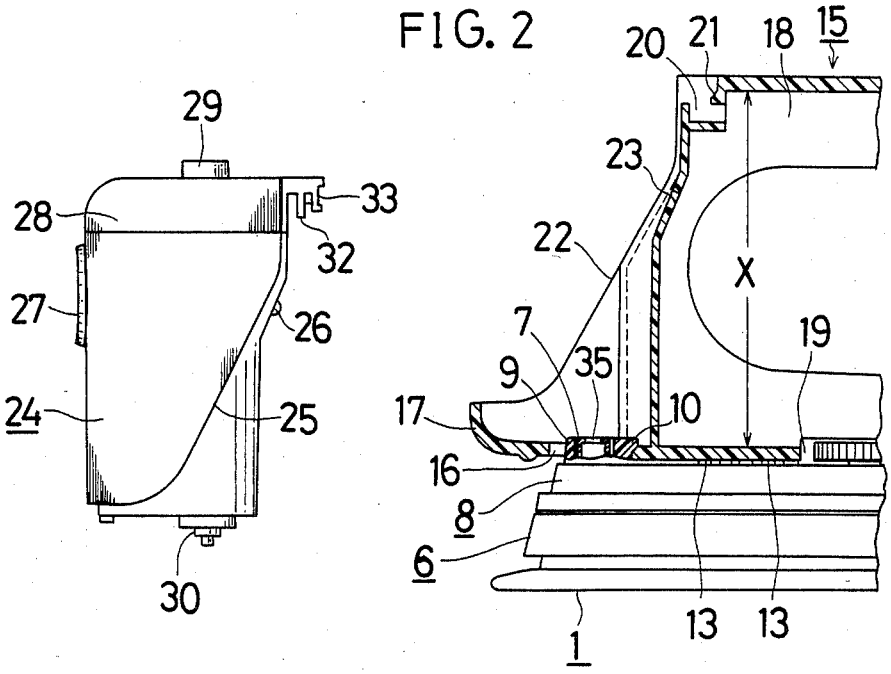
FIG. 2 is a partial exploded view for illustrating the reservoir separated from the iron main body.

FIG. 1 illustrates a steam iron assembled for use, in which a box-like casing 15 for storing therein an iron main body 1 is mounted on the main body 1 to constitute a handle. A water reservoir 24 is housed in the front portion of the casing 15. The reservoir 24 can be detached as shown in FIG. 2.

Referring at first to the thin iron main body 1, there is shown a soleplate 2 having a generally trigonal front end, a steam generating chamber 3 defined at the upper part of the soleplate 2, a plurality of steam emission apertures 4, perforated in the soleplate 2 for communicating the steam generating chamber 3 with the external atmosphere, a lid 5 covering the steam generating chamber 3 from above, an insulation cover 6 for covering the side and a part of the inside of the soleplate 2, and a communication cylinder 7 made of a heat resistant rubber material communicated at its lower end by way of the lid 5 with the steam generating chamber 3 and opened at its upper end to form a water charging or filling port 35 (shown in FIG. 2), which serves as a packing. The diameter of the communication cylinder 7 is enlarged at the lower end to provide a pre-heating chamber 39. As shown in FIG. 1, an insulation cover 8 forms the upper part of the iron main body 1, i.e. a part of a housing, and it has a protection cylinder 9 provided at the front portion thereof which substantially surrounds the entire circumference, except for the upper end, of the communication cylinder 7 with the water charging port 35. The protection cylinder 9 has a retaining protrusion 10 integrally projected rearwardly. A bulge 11 is provided at the rear portion of the insulation cover 8 which protrudes obliquely upwardly (refer to FIG. 4). The insulation covers 6 and 8 define a housing covering the upper side and the upper part of the soleplate 2. Heating elements 34 and 40 are mounted separately on the soleplate 2 in the inside of the steam generating chamber 3 and the elements 34 and 40 are electrically connected to an electric cord 38 for power supply led out externally from the rear side of the insulation cover 8 (FIG. 3) by way of contacts 37 of a thermostatic switch 36 disposed on the soleplate 2. Since the two heating elements 34 and 40 are separate, they may be used in different modes, for example, by a turning switch (not shown) such that both of them are simultaneously supplied with the input power while being connected in parallel with each other in a case where the voltage source at the electric cord 38 is low, e.g. 100–120 V or only one of them is supplied with the input power in a case where the voltage source at the electric cord 38 is higher, e.g. 200–240 V. In this way, the power consumption in the heating elements can be kept substantially at a constant level. A manual adjusting means (a dial) 12 is disposed at the upper surface of the insulating cover 8 for controlling the on-off temperature level of the contacts 37 of the thermostatic switch 36 to vary the setting temperature. The top face of the dial 12 is made lower than a line (l) connecting the respective top ends of the protection cylinder 9 and the bulge 11. A plurality of protrusions 13 are formed being arranged side by side at the upper surface of the insulation cover 8 integral therewith, which are able to be in close contact with the casing 15 upon mounting. A locking mechanism 14 which is a retainer for the box-like casing 15 is disposed at the bulge 11 and resiliently biased forwardly by a coil spring 41 incorporated within the cover 8.

Figure 6:
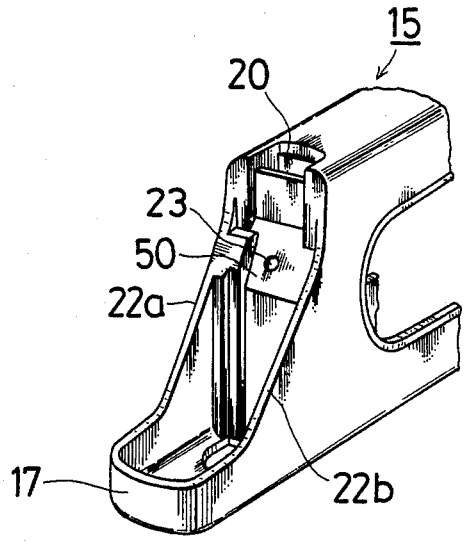
FIG. 6 is a perspective view for the front portion of the casing shown in FIG. 1.
Figure 7:
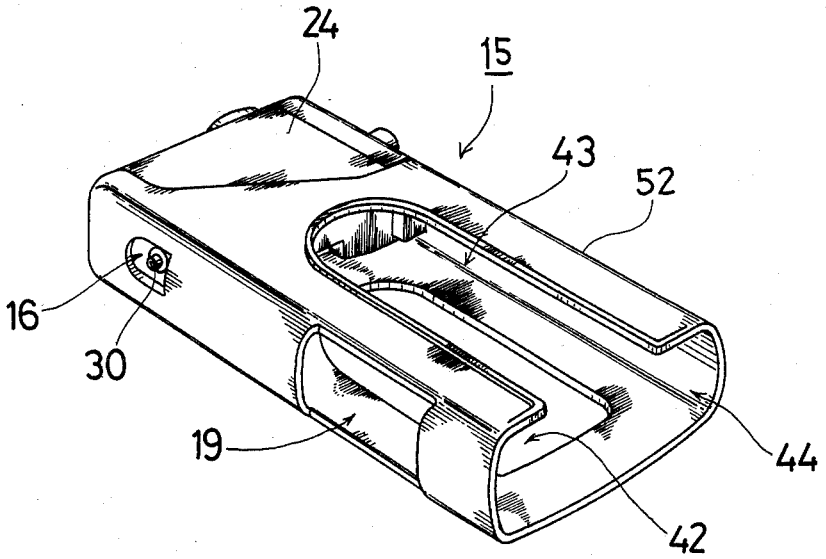
FIG. 7 is a perspective view for the casing shown in FIG. 1.

The box-like casing 15 (hereinafter referred to as a handle) is detachably mounted on the upper surface of the iron main body 1 to constitute a handle. As shown in FIGS. 2, 6 and 7, a protection cover 17 having an insertion hole 16 is located at the lower front portion of the handle 15, which provides a space for accommodating thereon the reservoir 24. A retaining groove 20 and a retainer 21 for the reservoir are provided at the upper front portion of the handle 15. As shown in FIG. 6, slant receiving edges *22a, 22b* for the water reservoir are formed for connecting the front end of the protection cover 17 and the upper front portion of the handle, and a retaining hole 23 is apertured to a slant wall 50 recessed between the slant receiving edges *22a* and *22b*. The handle, i.e. the casing 15 with a housing space 18 is of a generally rectangular hollow body with substantially the same thickness at that of the iron main body 1. The width (X) of the housing space 18 for the iron main body shown in FIG. 2 is made somewhat wider than the width (Y) of the iron main body 1 shown in FIG. 3. As shown in FIG. 7, the handle 15 is formed at its rear part with a rear-opening 44 for inserting and removing the iron main body 1. A housing space 19 is provided by recessing the lower portion of the handle 15 for housing the dial 12. A gripping part 52 of the handle 15 is formed with side openings 42 and 43 for inserting fingers upon using the iron.

Figure 3:
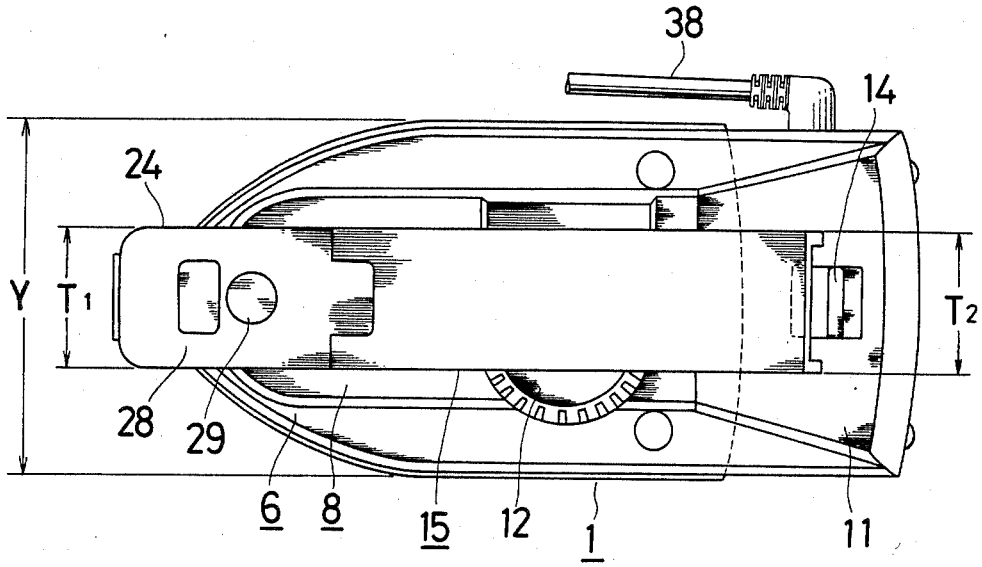
FIG. 3 is a plan view of the steam iron assembled for use.

Referring now to the water reservoir, a transparent or semi-transparent water reservoir 24 is detachably mounted in front of the handle 15 and it has substantially the same thickness (T1) as the thickness (T2) of the handle 15 as shown in FIG. 3, and has substantially the same width (W1) as the width (W2) of the handle 15 as shown in FIG. 1. As clearly seen in FIG. 2, the reservoir 24 comprises a slant saddle portion 25 disposed on both side walls thereof for connecting the upper rear-face and the lower front face, a retaining protrusion 26 disposed at the inside of the saddle portion 25 being protruded from the slant wall of the saddle, a water feeding opening 27 disposed at the upper front of the reservoir 24, a decorative plate 28 secured at the upper part of the reservoir, a water charging valve 30 disposed at the bottom of the reservoir, a switching knob 29 mounted on the decorative plate for switching the operation to "STEAM", "DRY", which vertically moves an actuation lever 31 whose lower end actuates the water charging valve 30 thereby to turn on or off the valve 30, and an engaging piece 32 and an engaging finger 33 disposed adjacent to each other at the upper rear part of the decorative plate 28.

The method of using the steam iron having such a construction is explained next. Referring to the way of mounting the water reservoir and the handle, as well as of mounting the handle attached with the reservoir to the upper surface of the iron main body, the reservoir 24 is at first attached to the handle 15 and then the handle 15 is mounted on the upper surface the iron main body 1. Procedures for mounting each of the components are to be described specifically. Upon mounting the water reservoir 24, the reservoir is moved downwardly toward the handle 15 while positioning the water charging valve 30 within the insertion hole 16 in the protection cover 17 of the handle 15 and while fitting the engaging piece 32 into the retaining groove 20 engaging the engaging finger 33 by the resilient action of the retainer 21. Accompanying the mounting movement of the reservoir 24, the retaining protrusion 26 of the reservoir 24 is in resilient contact along the slant wall to fit into the retaining hole 23, whereupon the mounting of the reservoir 24 is completed. It is designed such that the lower end of the water charging valve 30 is situated on the inner side of the protection cover 17, so that the valve 30 may not abut against other objects or a floor surface which would cause deformation. As the reservoir 24 is mounted, the slant saddle portion 25 of the reservoir 24 rides on the slant receiving edges 22*a*, 22*b* of the handle 15.

The insertion hole 16 of the handle 15 is fitted with the retaining protrusion 10, while the rearward part of the handle 15 is retained by the locking mechanism 14. With this attaching operation of the handle 15, the water charging valve 30 is connected with the water charging port 35 at the top of the communication cylinder 7 and in communication with the steam generating chamber 3, while the dial 12 is situated within the housing space 19. The front end of the soleplate 2 is adapted to be positioned behind the front face of the reservoir 24.

When the mounting of the respective components has thus been completed, the heating elements 34, 40 are electrically energized. When the switching knob 29 is pushed to the position for "STEAM" to open the water charging valve 30, the water in the reservoir 24 drops into the communication cylinder 7 and is heated in the pre-heating chamber 39 by heating elements 34, 40, through the lid 5 at the lower end of the cylinder. The pre-heated water falls downwardly into the steam generating chamber 3 and is further heated in the chamber until high temperature steam. The steam thus generated is jetted out through the steam emission apertures 4. When the switching knob 29 is turned, alternatively, to the position for "DRY", the water charging valve 30 is closed and the iron can be used without steam.

If it is intended to feed water to the reservoir 24, the reservoir 24 is pulled up with a sufficient force while gripping the both sides thereof to cancel the engagement between the engaging finger 33 and the retainer 21 and between the retaining protrusion 26 and the retaining hole 23. Then water is fed to the reservoir 24 from the water feeding opening 27 while holding only the reservoir thus separated as shown in FIG. 2.

Figure 4:
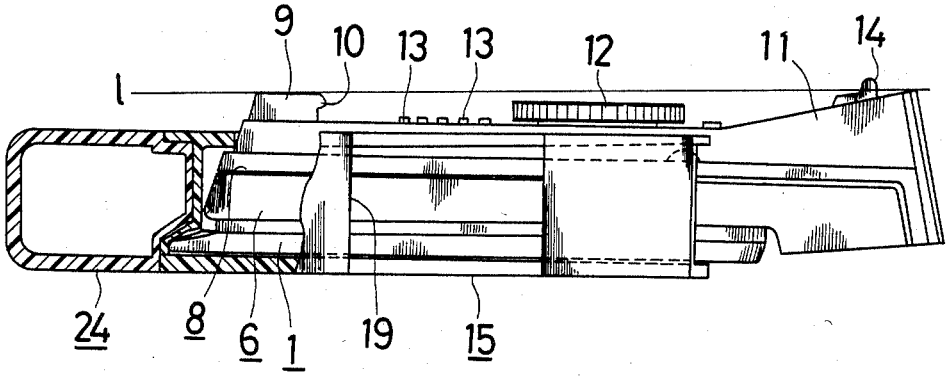
FIG. 4 is a side elevational view partially in section of the iron main body stored in the casing.

Upon storing the iron of this embodiment, the locking mechanism 14 is released to disengage the retaining protrusion 10. The soleplate 2, the entire part of the insulation cover 6 and a portion of the insulation cover 8 are housed in the housing space 18 of the handle or casing 15 as shown in FIG. 4.

Figure 5:
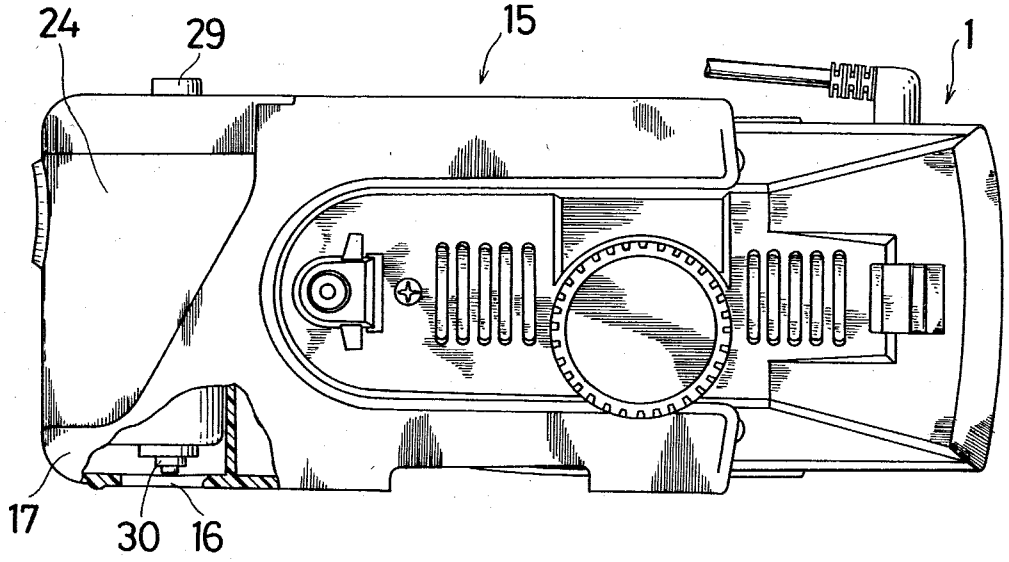
FIG. 5 is a plan view for the iron shown in FIG. 4.

FIG. 5 also shows the position for storing the iron where the iron main body 1 is housed in the casing 15 mounted with the water reservoir 24. Since the lower end of the water charging valve 30 is located to the inner side of the protection cover 17, it may not protrude to the outside of the casing 15. The water charging valve 30 can be protected against damage and the user's hand is protected from being injured by the lower end upon handling the iron. Further, since the forward portion of the iron main body 1 is housed within the casing 15 and thus the trigonal pointed front end of the soleplate 2 can be concealed, the user is free from the risk of injury from the pointed end.

In addition, since the entire body of the iron is in a substantially thin rectangular shape, it can take a compact configuration easy to pack for travel.

Further, the casing 15, as it is attached to the upper surface of the iron main body 1 upon use, is situated such that the rear end of the casing 15 is ahead of the rear end of the iron main body as shown in FIG. 1. Therefore, when the user temporarily leaves the iron during use, the iron can rest on the working table or the like in a well balanced manner with the rear face of the iron resting on the table, whereby the bottom of the heated soleplate 2 can advantageously be kept from directly contacting the table surface or the like.

Furthermore, since the front end of the soleplate 2 is situated behind the front face of the water reservoir 24 as shown in FIG. 1, the user is prevented from accidentally touching the heated soleplate 2 during use.

A plurality of protrusions 13 formed on the upper surface of the insulation cover 8 are located between the casing 15 and the iron main body 1 when they are attached to each other to ensure reliable securing therebetween. A connector may be provided to the main body 1 at the outlet of the electric cord so that the cord can be attached removably.

The portable type steam iron described above as a preferred embodiment of this invention can actually be manufactured in various sizes and specifications as desired, and one of such practical examples is illustrated below only for the reference.

The casing 15 for housing the iron main body 1 has a thickness (T2) of 32 mm (FIG. 3), a width (W2) of 95 mm (FIG. 1) and a length of 162 mm with the water reservoir 24 attached. The iron main body 1 has the maximum thickness (distance between the soleplate 2 and the top of the bulge portion at the rear portion) of 45 mm and a width (Y) of 82 mm (FIG. 3). Accordingly, the entire iron structure sized 135 mm height, 82 mm width and 190 mm length when in use is reduced into a thin rectangular configuration sized 45 mm thickness, 95 mm width and 225 mm length which is compact and convenient for travel or storage. In addition, since almost of the structural components, except for electric parts, are made of plastic materials, the total weight can be decreased to less than 750 g which is highly desired as a portable type iron, although it has a relatively large electric consumption of about 700 W at the maximum.

Figure 8:
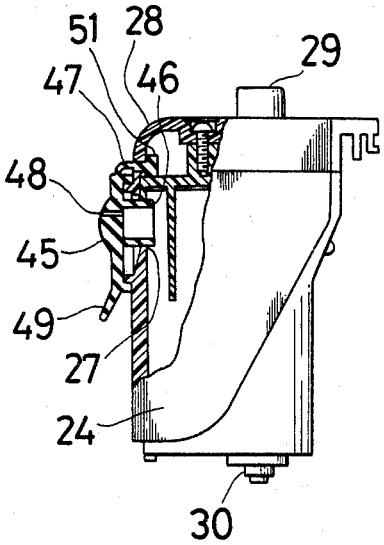
FIG. 8 is a side elevational view partially in section of the reservoir in another embodiment according to this invention.
Figure 9:
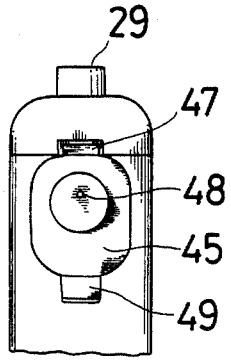
FIG. 9 is a front elevational view for a portion of the reservoir shown in FIG. 8.

FIG. 8 and FIG. 9 show another preferred embodiment of the water reservoir in this invention.

This water reservoir has the same structure as that of the reservoir 24 shown in FIG. 2 except that a cap 45 is mounted. The cap 45 comprises a cylindrical fitting plug 46 to be fit into the water feeding opening 27, a connection member 47 extended from the upper part of the cap 45, an engagement 51 formed at the top end of the connection member 47 and engaged by being retained with the decorative plate 28, a tongue 49 to be pulled upon detaching the cap 45 and an air relief hole 48, which are integrally moulded with rubber. When water is supplied to the reservoir 24, the tongue 49 is pulled to take off the fitting plug 46 from the water feeding opening 27. In this case, the cap 45 connected by means of the flexible connection member 47 to the decorative plate 28 is displaced ahead of the decorative plate 28 and, therefore, water is supplied to the reservoir 24 through the fully opened water feeding opening 27 and the cap does not hinder the feed of water to the water feeding opening 27.

Then, after the water has been fed completely to the reservoir 24, the fitting plug 46 of the cap 45 is again fit into the water feeding opening 27. Thus, attachment of the cap 45 to the reservoir 24 can prevent water stored in the reservoir from spilling accidentally to the outside. The connection member 47 keeps the cap 45 from detaching from the reservoir 24 and being misplaced.

What is claimed is:

1. A portable steam iron comprising:

an iron main body of reduced thickness, said iron main body comprising a soleplate, a housing mounted on said soleplate, a water charging port protruding at a front part of an upper surface of said housing, a steam generating chamber inside said housing, a heating element for heating said steam generating chamber and said soleplate, a thermostatic switch connecting a power supply to said heating element, means for manually adjusting said thermostatic switch, said switch being mounted on said housing, and an electric cord connected to said thermostatic switch for supplying electric power from an external power source to said heating element; and a box-like thin casing having openings to accomodate two attachment positions on the iron main body and having the same thickness as said iron main body, said casing being a generally rectangular hollow body, the external front part having a space for receiving a water reservoir, said casing having an opening at its rear part for inserting said iron main body into a first position when said portable steam iron is not in use, said hollow body constituting a cavity capable of accomodating at least one-half the length of said iron main body from its front end, said casing being detachably mounted in a second position on said iron main body to constitute a handle when said portable steam iron is in use, one side of said casing being a gripping part;

said water reservoir further comprising a generally rectangular body with a shape corresponding to said reservoir receiving space on said casing, means for externally monitoring a level of water contained therein, a water feeding opening provided at the upper part thereof, a water charging valve at the bottom of said reservoir, and means for manually turning on and off said water charging valve at the upper part thereof, said water charging valve being positioned inside of said casing so as to engage said water charging port by way of an insertion hole passing through a side of said casing when said casing is mounted in said second position.

2. The steam iron as claimed in claim 1, wherein the water reservoir is detachably mounted on the casing.

3. The steam iron as claimed in claim 1, said water reservoir further comprising a cap for the water feeding opening.

4. The steam iron as claimed in claim 1, said housing further comprising a forward retainer and a rearward retainer on the upper surface of the housing, said casing being held on the upper surface of said housing by both of the retainers when said portable steam iron is in use.

5. The steam iron as claimed in claim 4, wherein said water charging port passes through said forward retainer and is flush with the top face of the forward retainer.

6. The steam iron as claimed in claim 4, wherein the casing is retained at the lower front end by the forward retainer and at the lower rear end by the rearward retainer which is biased by a spring.

7. The steam iron as claimed in claim 4, wherein the manual adjusting means for the thermostatic switch is situated below a line connecting the forward retainer and the rear end at the upper surface of the housing.

8. The steam iron as claimed in claim 1, wherein the water charging port has an internal packing of a heat resistant elastic resin.

9. The steam iron as claimed in claim 1, wherein the water charging port communicates with the steam generating chamber through a communication cylinder which has a preheating chamber at the lower end thereof.

10. The steam iron as claimed in claim 1, wherein the casing when it is attached to the upper surface of the iron main body is situated such that the rear end of the casing is ahead of the rear end of said iron main body.

11. The steam iron as claimed in claim 1, wherein the front end of the soleplate is situated behind the front face of the water reservoir when the casing mounted with said reservoir at the front portion is mounted on the upper surface of the housing.

12. The steam iron as claimed in claim 1, wherein the upper surface of the housing is disposed with a plurality of protrusions which are in close contact with the casing upon mounting of said casing.

13. The steam iron as claimed in claim 1, wherein the electric cord is detachably connected to the iron main body.

14. The steam iron as claimed in claim 1, wherein each of the iron main body and the casing therefor has a thickness not greater than 45 mm.

* * * * *